US006406023B1

(12) United States Patent
Rowe

(10) Patent No.: US 6,406,023 B1
(45) Date of Patent: Jun. 18, 2002

(54) BLACKJACK GAME EACH PLAYER HAVING MULTIPLE HANDS

(75) Inventor: Richard E. Rowe, Reno, NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/492,512

(22) Filed: Jan. 27, 2000

(51) Int. Cl.[7] ..... A63F 1/00
(52) U.S. Cl. ..... 273/292; 463/12
(58) Field of Search ..... 273/292, 274, 273/309; 463/12, 13

(56) References Cited

U.S. PATENT DOCUMENTS 5,280,915 A 1/1994 Groussman ..... 273/292
5,328,189 A * 7/1994 Malek ..... 273/292
5,531,448 A * 7/1996 Moody ..... 273/292
5,702,104 A * 12/1997 Malek et al. ..... 273/292
5,720,484 A * 2/1998 Hsu ..... 273/292
5,732,949 A 3/1998 Josephs ..... 273/292
5,829,750 A 11/1998 Booker ..... 273/292
5,873,571 A * 2/1999 Vaisman et al. ..... 273/292
6,000,699 A 12/1999 Long ..... 273/292
6,131,909 A * 10/2000 Chilese ..... 273/292

* cited by examiner

*Primary Examiner*—Benjamin H. Layno
(74) *Attorney, Agent, or Firm*—Garrettson Ellis Seyfarth Shaw

(57) ABSTRACT

A physical card game or electronically simulated card game is provided in which each of one or more players received cards which define two or more card hands, with at least one card in common. In one embodiment, the initial cards are arranged in a rectangular array with rows, columns and/or diagonals of the array defining the hands. Each hand can be played and/or evaluated using certain aspects of blackjack, poker or other traditional card game play or evaluation. At least some prizes or top winning outcomes for a round of play must include winning outcomes from at least two, and preferably from all, of the hands played by a given player. The relatively low odds of achieving highest-winning combinations on all hands makes it feasible to provide the game with relatively large prizes associated with such low-probability outcomes. In one embodiment, certain subcombinations of a player's cards, such as all initially-dealt cards, are evaluated for instant win combinations. In one embodiment, one or more additional cards may be dealt for use in defining some or all of said instant win combinations.

19 Claims, 3 Drawing Sheets

BLACKJACK GAME EACH PLAYER HAVING MULTIPLE HANDS

The present invention relates to a card game in which a single player may play multiple hands at the same time, preferably with two or more of the hands having common cards and preferably in a form that can be configured for either traditional table play or electronic play.

BACKGROUND INFORMATION

Many casino players or other game players are especially attracted to games which include relatively large prizes (typically in addition to numerous smaller prizes). Large prize games are believed to attract casino customers even when the large prizes have relatively small odds (relatively low probability of being won, in any round of the game) and, indeed, it generally is found that casinos must provide relatively low odds for larger-sized prizes, as a practical matter.

This situation can present problems with regard to many traditional games involving or based on real or simulated card decks since the traditional winning hands for many such games have odds of occurrence which are too high to make it feasible to provide relatively larger prizes. Accordingly, it becomes desirable to modify traditional card games to provide for at least some winning hands or outcomes with relatively low odds of occurrence and which, accordingly can be feasibly associated with relatively large prizes.

Although there are numerous manners of potentially modifying traditional games to include low-odds winning outcomes, it is believed especially useful to provide modifications in such a fashion as to maintain a high level of entertainment value or other interest-generating aspects of the game and/or to maintain certain of the features of the games with which players may be familiar and/or comfortable. For example, although relatively low-odds winning hands can be provided by defining hands which have a large number of cards (e.g. a modified poker hands with 13 cards could have relatively low odds of achieving a 13-card straight), it is believed that players prefer to have a number of cards, per hand, similar to that traditionally associated with the game (such as five cards or seven cards for poker hands). Accordingly, it would be useful to provide modifications for traditional card games which can include hands with a number of cards similar to the number of cards in traditional hands for that game, but which still define winning outcomes having a relatively low probability of occurrence (thus making feasible relatively higher prizes, associated with such outcomes).

It is believed that while many players prefer electronic or "slot" games, others prefer games which are played with ordinary (physical) card decks and/or prefer to have the ability to switch between substantially similar electronic and table versions of a game. Accordingly, it would be useful to provide for modifications to traditional games which not only can make it feasible to provide relatively large prizes but also which can be readily implemented as either table games or electronic games.

In certain casino games especially electronic games, it is possible to use programming or other techniques to define odds for certain game outcomes which are substantially different from odds that can occur in response to cards or other physical gaming objects. For example, it would be possible to decrease the odds of achieving a particular poker hands outcome, such as a royal flush, in an electronic poker machine, by configuring the programming such that the royal flush occurs at a relatively low frequency (i.e. lower than the frequency with which a royal flush occurs in ordinary play with a physical deck of cards). However, such manipulation of odds may be prohibited by gaming regulatory authorities and, in any case, may be confusing or annoying to potential casino players who may expect probabilities of electronic card decks to closely resemble probabilities found in physical card decks (with which any players may be familiar). Accordingly, it would be useful to provide modifications of card games which can provide one or more outcomes with relatively low probabilities of occurring, without substantially departing from the probabilities that would occur using a physical deck of cards.

SUMMARY OF THE INVENTION

The present invention is primarily directed to a game involving real or simulated cards in which a given player, during any one round of the game play, effectively has two or more card hands at the same time. Preferably, there is at least one card which is common to two or more of the hands and, even more preferably at least two cards in any one hand are also cards which are cards of at least one other hand, and preferably are cards of at least two different hands.

In one embodiment, the player receives four cards in a rectangular array with the two cards of the two columns (or two rows) being members of first and second different hands and the two diagonally-positioned sets of cards being members of third and fourth different hands. In one embodiment, the four cards in the array can provide an "instant" outcome, e.g. if the cards constitute a predefined winning outcome such as a winning poker outcome (e.g. four of a kind) or a blackjack winning outcome (cards totaling 21). Preferably, in the absence of an "instant win", players can continue to play towards a winning poker or blackjack hand by receiving additional "draw" cards in any or all of the four hands. Because a single player can potentially obtain winning hands in all of a multitude of (e.g. four) hands, it is possible to provide one or more relatively large prizes associated with such a relatively improbable outcome, while still providing game play, with respect to each of the multiple hands, which substantially comports with blackjack, poker or other card game rules with which the player may be familiar.

According to one aspect, a physical card game or electronically simulated card game is provided in which each of one or more players received cards which define two or more card hands, with at least one card in common. In one embodiment, the initial cards are arranged in a rectangular array with rows, columns and/or diagonals of the array defining the hands. Each hand can be played and/or evaluated using certain aspects of blackjack, poker or other traditional card game play or evaluation. At least some prizes or top winning outcomes for a round of play must include winning outcomes from at least two, and preferably from all, of the hands played by a given player. The relatively low odds of achieving highest-winning combinations on all hands makes it feasible to provide the game with relatively large prizes associated with such low-probability outcomes. In one embodiment, certain subcombinations of a player's cards, such as all initially-dealt cards, are evaluated for instant win combinations. In one embodiment, one or more additional cards may be dealt for use in defining some or all of said instant win combinations.

DETAILED DESCRIPTION OF THE PREFERRED EMBODIMENTS

Figure 1:
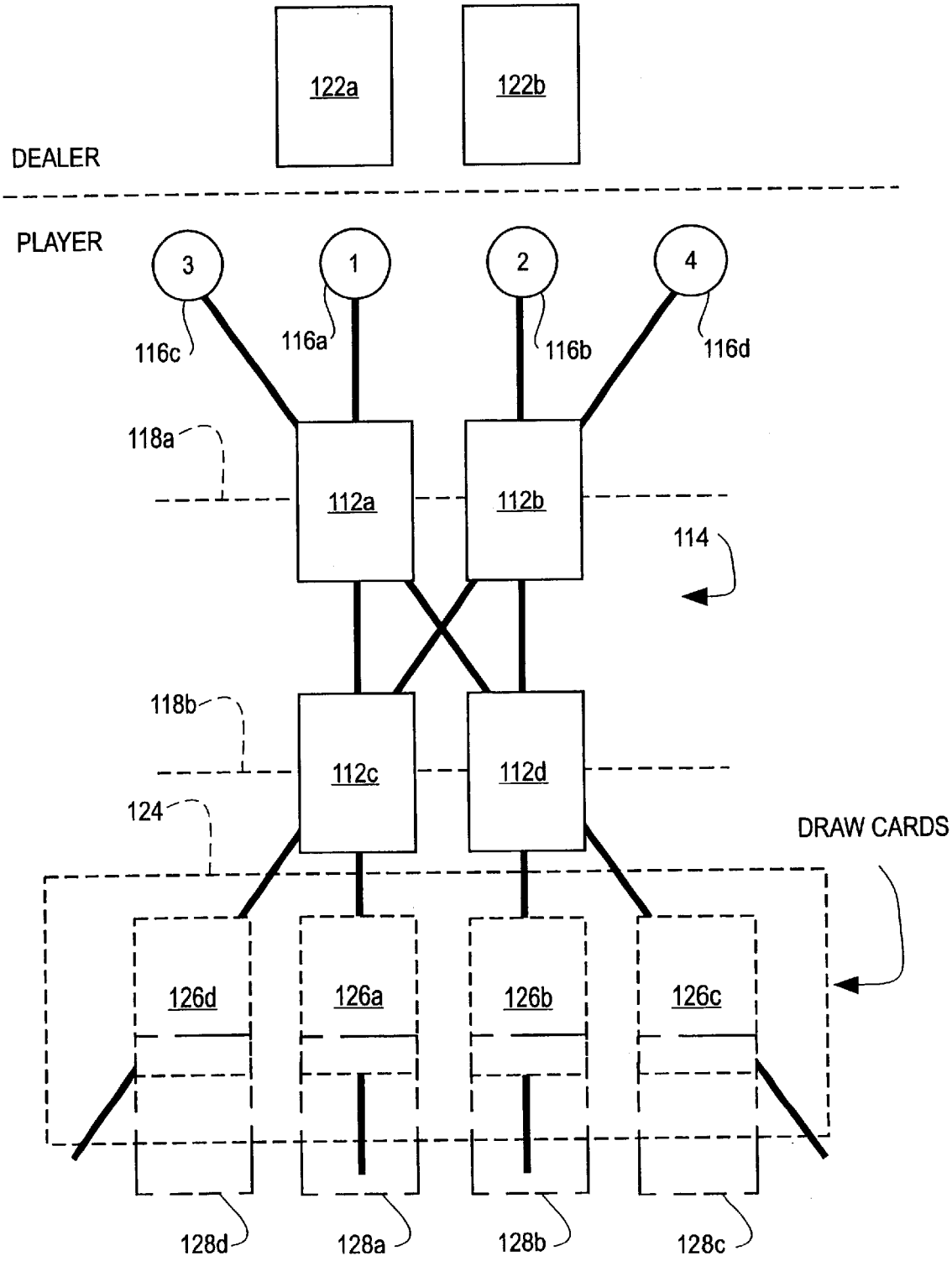
FIG. 1 displays an array of card positions for table or electronic play according to one embodiment of the present invention.

FIG. 1 depicts an arrangement of cards during game play according to an embodiment of the present invention. There are numerous manners of implementing the game having multiple hands with at least one common card and at least some manners of implementation (and variations) are described below. The arrangement of cards depicted in FIG. 1 can be an arrangement of physical cards dealt from a deck, or a display, e.g. on a computer controlled CRT, LCD or similar display device. As depicted in FIG. 3B, a gaming terminal 412 typically provides a mechanical or electronic display which can include a touch screen display 414, e.g. for providing player input, coupled to a microprocessor 416 controlled by a program stored in memory 418. A keyboard 422 or other input device may be provided for user input. Wagers can be accepted, e.g. using a coin acceptor 424, bill acceptor 426 and/or card acceptor 428. Those of skill in the art will understand how to implement card game actions, such as dealing, discarding, drawing cards and the like in an electronic (simulated) card game machine, after understanding the present disclosure.

In one embodiment, preferably following an initial wager 312 a player is dealt four cards arranged in a 2×2 array 114. In some embodiments, one or more combinations or arrangements of the initially-dealt cards 112*a, b, c, d* are defined as "instant win" combinations or arrangements. At least some of these embodiments will be described more thoroughly below. In the depicted embodiment, the four cards are components of at least four different hands 116*a, b, c, d* with the first hand 116*a* including the two cards 112*a, c* in a first column, the second hand 116*b* including cards 112*b, d* in a second column, the third hand 116*c* including cards 112*a, b* in a first diagonal and the fourth hand 116*d* including cards 112*b, c* in a second diagonal. It is also possible to define hands according to rows of cards 118*a, b* or to provide other card arrangements to define or assist in displaying numerous card hands having one or more cards in common, as will be apparent to those of skill in the art after understanding the present disclosure.

As seen in FIG. 1, the card hands 116*a, b, c, d* are configured such that there are common cards (i.e. cards which are components of more than one hand). According to an embodiment of the present invention, there is at least one card which is common to at least two different hands. Preferably, of the initial four cards dealt in FIG. 1, each card 112*a, b, c, d* is a component of at least two hands (e.g. card 112*a* is a component of both first hand 116*a* and the third hand 116*c*) and each hand has at least one card which is common with at least one other hand (in the configuration FIG. 2, both initial cards of each hand are common to other hands). In one embodiment, the cards in the top row 112*a, b* are dealt face up so that the dealer (and any other parties) can view such cards. In one embodiment, the second two cards 112*c, d* are dealt face down, and are unknown to the dealer at the time of initial dealing. However, in at least one electronic version of the game, all cards 112*a, b, c, d* which are initially dealt are dealt face-up.

In the embodiment of FIG. 1, after the initial four cards are dealt 112*a, b, c, d*, the dealer is dealt two dealer cards, typically with one card being dealt face up and the other face down 316 so that the player (and any other interested parties) can see at least one of the dealer cards. In various embodiments, the game can be configured to permit or require additional wagers following the initial wager 312 and, in the embodiment of FIG. 3A, an additional wager 318 is permitted following dealing of the initial four cards 112*a, b, c, d* and the dealer cards 122*a, b*. In other embodiment, additional wagers can be permitted or required prior to or following dealing of additional cards or draw cards 124.

Figure 3A:
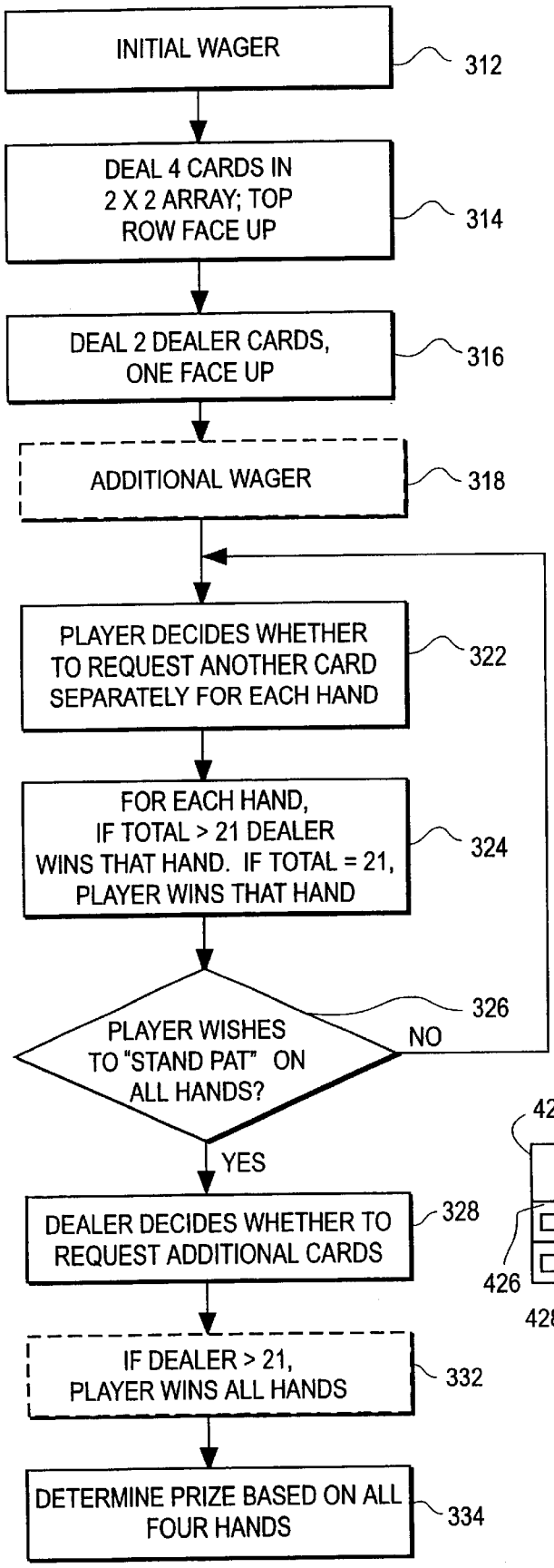
FIGS. 3A and 3B are flow charts depicting a gaming procedure according to embodiments of the present invention.
Figure 3B:
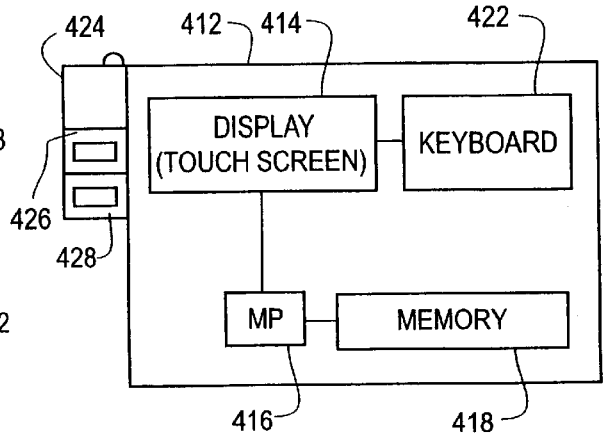

In the embodiment of FIG. 3A, a player is permitted to decide whether to request another card, preferably with the ability to make this decision separately with respect to each of the four hands 116*a, b, c, d*. In the case of a physical card game, the player can indicate this decision directly to the dealer whereas in the case of an electronic game, the player may indicate this decision using a touch screen or other input device. In another embodiment, the game can be configured such that, for some or all draw portions of the game, the player must either request a draw or "hit" on all four hands, or none of the four hands.

In a preferred embodiment, when a player requests an additional card for a particular hand, the additional draw cards 124 are placed or arranged in a manner to readily display that card's association with a particular hand, e.g. as depicted in FIG. 1. As shown in FIG. 1, draw cards which are associated with one of the column hands 116*a, b* are positioned 126*a, b* directly below the existing columns of two cards 112*a, c* and 112*b, d* respectively). When the player requests additional draw cards with respect to either the diagonal hands 116*c*, 116*d*, the additional card 126*c*, are preferably arranged so as to be positioned along the diagonal lines, as depicted. If yet further cards in any of these hands is permitted and requested, such additional cards are preferably positioned substantially adjacent 128*a, b, c, d* the first draw cards 124, as depicted.

After any additional draw cards requested have been dealt, it is determined, preferably separately for each hand, whether the hand is a "bust" hand (has a total exceeding 21, calculated using normal blackjack card values, in which case the player "loses" on that hand), or if the value of one or more hands is exactly equal to 21 (in which case the player wins that hand, in some embodiments only if the dealer does not also have a dealer hand totaling 21). As used herein, blackjack card valuation refers to traditional valuation in a blackjack game, e.g. as described in Hoyles rules (or similar authorities), incorporated herein by reference. Although it is preferred to make separate bust and/or win evaluations with respect to each hand, it is possible to configure some embodiment invention such that a bust on any one hand (or more than a predetermined number of hands) results in a loss of the entire round.

When the player has indicated no further desire to receive additional draw cards, i.e. has decided to "stand pat" on all four hands 326, in at least some embodiments, the dealer and/or computer program determines whether to request additional dealer cards 328. In at least some embodiments, the decision with respect to additional dealer cards must comply with certain (typically known or published) rules, such as rules requiring the dealer to stand pat whenever the dealer total is at or above a predetermined total. In at least one embodiment, if the dealer total exceeds 21 (i.e. the dealer busts) the player automatically wins all four hands 332 (or at least all hands on which the player has not already busted).

After the dealer has taken all desired additional cards, any cards which were previously undisplayed (i.e. face down)

are revealed and the results of the game round are evaluated to award appropriate prizes. In the embodiment of FIG. 3A, the prize (if any) awarded the player 334 is based on all four hands 116*a, b, c, d* in the sense that there is at least one prize which is associated with a predetermined result (or class of results) in each of the hands. In one embodiment, the largest prize is awarded when all four hands 116*a, b, c, d* total 21. In other embodiments, the largest prize is awarded if all four hand beat the dealer (i.e. are closer to the total of 21 than the dealer's hand, although perhaps not all are equal to 21). Because of the relatively low probability of achieving, e.g., all four hands equaling 21, this embodiment of the present invention is particularly useful by making it more feasible to provide relatively large prizes (which is a situation considered particularly attractive to at least some players). It is believed useful in this context to provide other, smaller prizes, including prizes associated with outcomes in some but not all hands such as a prize associated with achieving 21 in three out of four hands, two out of four hands, one out of four hands and the like, as well as other prizes for higher-odds outcomes.

In another embodiment, the present invention can be implemented based on a combination of two or more different modified games, such as having aspects of both blackjack and poker. For example, in one embodiment, a given hand of a player may be evaluated both as a blackjack hand (i.e. for determination of how close the hand approaches a total of 21 and/or for what type or class of poker hand is represented by each of the four hands. In one variation, the player may be required to designate, e.g. prior to requesting draw cards, for each hand, whether that hand will be evaluated as a poker hand or blackjack hand. In another variation, the decision whether to evaluate any of the hands as a blackjack hand or a poker hand is made according to one or more rules, such as selecting that evaluation which results in the highest overall prize to the player. In yet another variation, all hands are evaluated as both poker hands and blackjack hands (e.g. a total of 8 hand evaluations are performed in a 4-hand game).

Although the embodiment of FIG. 1 illustrates a card arrangement consistent with a game in which there is both a player hand and a dealer hand, it is also possible to implement embodiments of the present invention in which there is no dealer hand, but only hands of one or more players. For example, all player hands may be evaluated on the basis of how closely the hands approach (without exceeding) a total value of 21, i.e. without reference to how closely a dealer hand may approach a total of 21. Although it is contemplated that embodiments without a dealer hand are particularly useful in the context of an electronic card game, there is no theoretical reason why a game without a dealer hand cannot be implemented using a physical card deck. It is possible to provide a game that has any of a number of types of interactions between blackjack hand evaluations and poker hand evaluations. For example, in some embodiments, a hand which represents a blackjack "bust" hand is disqualified from being considered for a poker hand prize, whereas in other embodiments, a hand may be eligible for a prize when evaluated as a poker hand, even though it may represent a blackjack bust hand.

In some embodiments, one or more outcomes having relatively small odds (e.g. so as to make relatively large prizes feasible) are defined which have a lower probability of occurring than, e.g. an outcome of 21 on all four hands. For example, although there are many possible card combinations which provide a total of 21 (or any other particular total value) there are some combinations or card deal/draw orders which are more unlikely to occur than others, even though they may all result in a total of 21, i.e. is it harder (more improbable) to "make" 21 in some ways (using some card combinations, orders and the like) than others. Accordingly, in some embodiments, the top prize may be associated with achieving a total of 21 in all four hands only when the total is achieved in a particularly improbable card combination or order, in some or all of the four hands. The same analysis is also true of, e.g. poker hands. For example, there may be many card deal orders which result in a four-aces, one-king hand, but there is a relatively low probability that such hand will have resulted from dealing the four aces prior to the king and even lower probability that the four aces will be dealt in a specific suit order, such as spades, hearts, clubs, diamonds. Accordingly, when it is desired to provide relatively high prizes, this can be facilitated, according to an embodiment of the present invention, by associating prizes not only with predetermined results (or classes of results) in all four of the hands but also associating the prizes with achieving such hands by particular combinations of cards or dealt-order of cards.

In one embodiment, certain groups, subsets, or combinations of cards dealt to a player may be defined as "instant win" situations, i.e. entitling the player to one or more prizes before, or without the need for, following the entire dealing, draw card and/or wagering procedure depicted in FIG. 3A. For example, in one embodiment, if the initially-dealt cards provide a blackjack hand (i.e. provide a total equaling 21) and/or provide one or more predefined poker card combinations, a player will be awarded a prize. For example, the poker card combinations could include four of a kind, a four card straight, or, if desired, other combinations valid in draw poker. In one variation, if an instant win combination occurs, the prize is awarded and game round is over. In another embodiment, the prize is awarded but the player can continue to play (e.g. as depicted in FIG. 3A) in an attempt to obtain further prizes for the hand for the game round.

Figure 2:
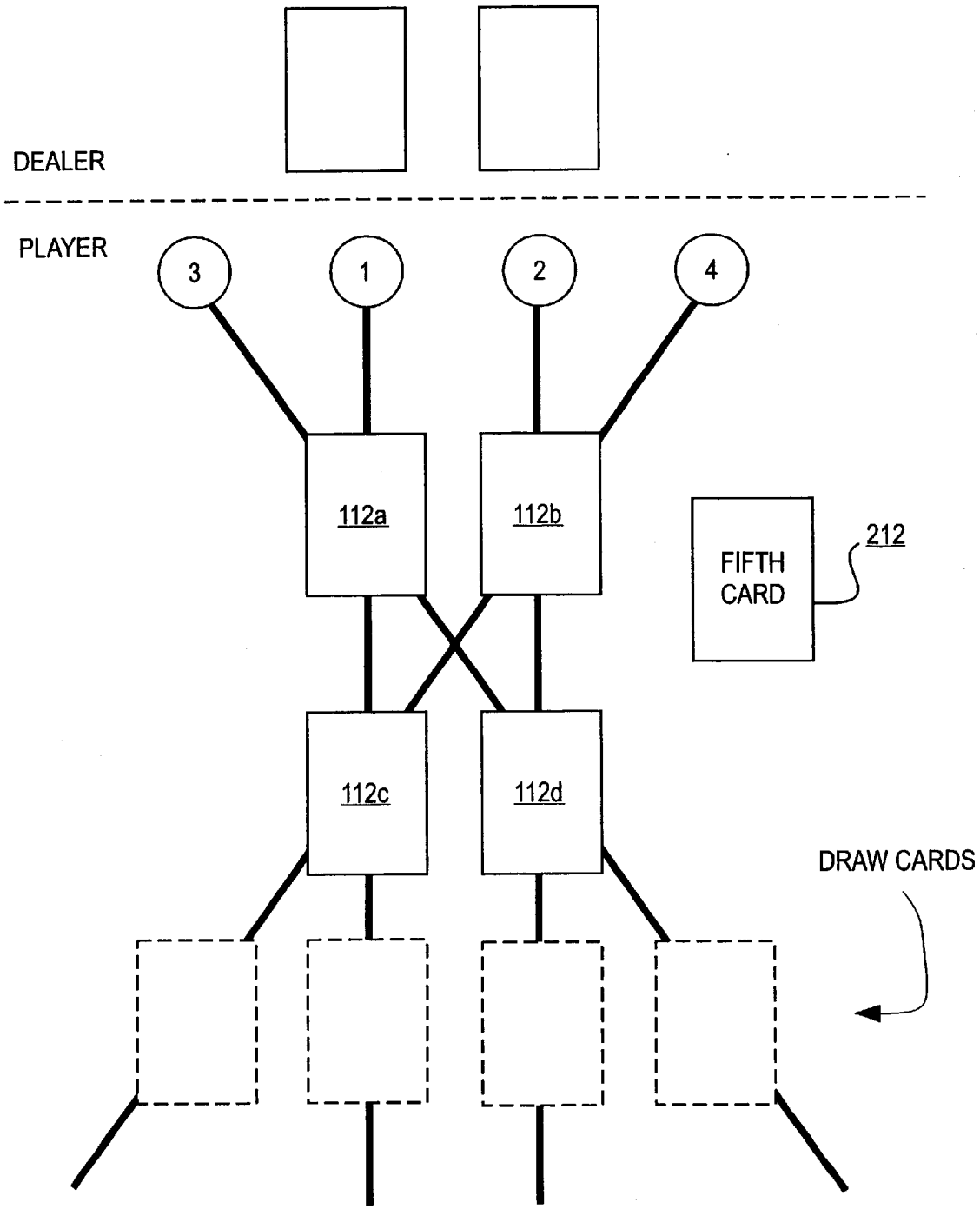
FIG. 2 depicts an array of card positions for electronic or table play according to an embodiment of the present invention.

In the embodiment depicted in FIG. 2, in addition to dealing the initial four cards 112*a,b,c,d* a fifth card 212 is dealt. The fifth card 212 can be used, in combination with the first four cards 112*a,b,c,d* to define a five-card hand for evaluation of a possible instant-win according to five card poker hand hierarchies. In one embodiment the fifth card 212 is always dealt and in other embodiments, the fifth card 212 is provided only in response to an additional wager from the player. In one embodiment, if there is no instant win using the fifth card 212, ordinary play of the game round (e.g. as depicted in FIG. 4A) continues without further use or play of the wild card or fifth card 212. In another embodiment, the player has the option to use the fifth card 212 as any one of the desired draw cards. In yet another embodiment, the player can decide whether he wishes to evaluate for a possible instant win and is permitted to proceed to normal play FIG. 3A only if he chooses to forgo an instant win evaluation or if the instant win evaluation results in an instant win. In other embodiments, instant win evaluations are always performed and players are always permitted to proceed to play the normal game round as depicted in FIG. 3A.

In light of the above description, a number of advantages of the present invention can be seen. The present invention provides a system for physical or simulated card gaming providing, in each round, multiple hands for a given player, preferably with at least one card in common to two or more of the hands. Providing game rounds in which players have numerous hands facilitates defining game outcomes having a relatively low probability of occurrence (and which can thus, feasiblely, be associated with the relatively large prizes) such as game round outcomes which include or relate to two or more, and preferably all, of the hands of a single player. In some embodiments, the particular cards or card types and/or the order in which particular cards are received, in order to achieve a given type or category of hand, are used in defining some or all winning outcomes. The present invention can be implemented while retaining many of the features of card games with which players are familiar (including, in some cases, retaining certain features of the generally known probabilities of occurrence for certain types of card combinations) such as by modifying traditional card games (such as blackjack, poker, and the like) so as to accommodate the provision of multiple hands for a single player in a given round of the game. In some embodiments, "instant win" or other prizes are associated with stages or groups of cards prior to, or in place of, the final game round evaluation such as being based at least partially on initially-dealt cards and preferably based on the results which correspond to certain winning results in traditional card games such as blackjack results, poker results and the like. In one embodiment, an instant win is based on evaluation of a group of cards which includes cards from two or more hands, preferably including cards from at least two hands which have no common cards, and even more preferably including substantially all initially-dealt cards. In one embodiment, the game includes aspects of both a traditional blackjack game and a traditional poker game.

A number of variations and modifications in the invention can be used. It is possible to use some aspects of the invention without using others. For example, it is possible to provide a game in which a player, in a given round, receives two or more different hands, with at least one card in common, but without the need for providing aspects of a poker game in addition to a blackjack game. Although multiple-hand common-card embodiments were described based on retaining at least certain aspects of traditional blackjack and/or five card draw poker, it is possible to provide games not based on any traditional card games and/or which use or retain some aspects of other types of card games such as seven card poker, stud poker and the like. Although FIG. 1 depicts an embodiment with a single dealer hand and a single player hand, it is also possible to implement embodiments of the present invention in which there are multiple players who receive cards from a single deck, during a round of play, each player playing against the dealer and/or with the players playing against one another. Although embodiments above were described in connection with a modification based on a blackjack game, the present invention can also be implemented as a modification of other card games such as a poker game, in fashions that will be understood by those of skill in the art after understanding the present disclosure. For example, in one embodiment, the dealer hand (if any) may include five cards and the top prize may be associated with achieving a predetermined poker hand (or class of poker hands) in each of the four player hands such as achieving four flushes, four straights, and the like, and/or all four of the player's hands beating the dealer's poker hand, although FIG. 1 depicts an embodiment in which a two-by-two rectangular array of cards is originally dealt, it is possible to find other ways to arrange or combine a plurality of cards to define two or more hands with at least one card in common. In some embodiments, rather than defining hands by columns and diagonals, hands can be defined by columns and rows, by rows and diagonals, by columns, rows and diagonals and the like. Other numbers and arrangements of initial cards can be used, such as providing three rows and three columns, two rows and three columns, two columns and three rows, four or more columns or rows and the like. Although FIG. 3A depicts a game process using certain aspects associated with traditional blackjack games, it is possible to implement embodiments of the present invention using other blackjack game aspects including "splitting", "doubling" and the like. Although in the embodiments of the present invention were described in which instant wins were evaluated without the use of or inclusion of any the draw cards, it is also possible to implement embodiments of the present invention in which an instant win can include some or all draw cards, either alone or in combination with initially-dealt cards and/or wild cards.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method useable for playing a card game comprising:

receiving at least a first wager;

randomly dealing, to at least a first player, a first predefined number of cards, at least some of said first predefined number of cards having different values and defining at least first and second different hands wherein at least one of said predefined number of cards is in both said first and said second hands, and wherein said first predefined number of cards comprises four cards arranged in a two-by-two array defining straight lines of cards, said first hand comprising a pair of cards parallel to card rows of said two-by-two array, and said second hand comprising a pair of cards in diagonal relation to said card rows of said two-by-two array; and evaluating the game outcome at the end of a round of play wherein said evaluating includes at least said first and said second hands and wherein at least a first prize is associated with said outcome only if both said first hand and said second hand are of at least first winning hand types.

2. A method as claimed in claim 1 further comprising receiving, from said player, an indication of a decision whether to receive additional cards in each of said hands.

3. A method as claimed in claim 1 further comprising dealing at least two cards to define a dealer hand.

4. A method as claimed in claim 3 further comprising awarding a highest prize only if a second predetermined number of said hands has a total value, evaluated according to blackjack card valuation, less than 22 but greater than the blackjack valuation of said dealer hand.

5. A method as claimed in claim 1 wherein said step of evaluating comprises evaluating each of said hands as a blackjack hand.

6. A method as claimed in claim 1 wherein said step of evaluating includes evaluating each said hand as a poker hand.

7. A method as claimed in claim 1, further comprising awarding a highest prize only if all of said hands provides a total value, calculated according to blackjack evaluation, of 21.

8. A method as claimed in claim 1 further comprising: performing an instant win based on said predetermined number of initially dealt cards for a predefined winning combination and awarding a prize if said instant win evaluation indicates a winning combination.

9. The method of claim 1 in which said game is played by electronic apparatus.

10. A method useable for playing a card game comprising:

receiving at least a first wager;

randomly dealing, to at least a first player, a first predefined number of cards, having different values, in an array defining at least two straight lines of cards, said straight lines of cards respectively defining first and second different hands, where at least one of the cards is in both said first and said second hands; and evaluating the game outcome at the end of a round of play, whereby said evaluating includes at least said first and second hands and wherein at least a first prize is associated with said outcome only if both said first hand and said second hand are of at least winning hand types.

11. The method of claim 10, further comprising the step of receiving from said player an indication of a decision whether to receive additional cards in each of said hands.

12. The method of claim 10 in which said straight lines of cards are at least three cards in length.

13. The method of claim 10 in which at least one of said straight lines of cards is parallel to rows of cards in square array and at least one of said straight lines of cards is diagonal thereto.

14. The method of claim 10 in which an added card which is in non-linear relation with said straight lines may be added to both said first and second hands.

15. The method of claim 10 further comprising dealing at least two cards to define a dealer hand.

16. The method of claim 10 in which said step of evaluating comprises evaluating each of said hands as a blackjack hand.

17. The method of claim 10 in which said step of evaluating comprises evaluating each said hand as a poker hand.

18. The method of claim 10 further comprising an instant win from said predefined number of initially dealt cards for a predefined winning combination, and awarding a prize if said instant win evaluation indicates a winning combination.

19. The method of claim 10 in which said game is played by electronic apparatus.

* * * * *